US012402740B2

(12) United States Patent
Ruiz et al.

(10) Patent No.: US 12,402,740 B2
(45) Date of Patent: Sep. 2, 2025

(54) WALL HANGER

(71) Applicants: Ernesto Ruiz, Wrentham, MA (US); Dale Hammond, Draper, UT (US)

(72) Inventors: Ernesto Ruiz, Wrentham, MA (US); Dale Hammond, Draper, UT (US)

( * ) Notice: Subject to any disclaimer, the term of this patent is extended or adjusted under 35 U.S.C. 154(b) by 68 days.

(21) Appl. No.: 18/513,538

(22) Filed: Nov. 18, 2023

(65) Prior Publication Data

US 2025/0160554 A1 May 22, 2025

(51) Int. Cl.
*A47H 1/00* (2006.01)
*A47H 1/102* (2006.01)

(52) U.S. Cl.
CPC ..... *A47H 1/102* (2013.01)

(58) Field of Classification Search
None
See application file for complete search history.

(56) References Cited

U.S. PATENT DOCUMENTS

| | | | | |
|---|---|---|---|---|
| 938,088 A | | 10/1909 | Sullivan | |
| 2,185,385 A | | 1/1940 | Rose | |
| 2,974,918 A | | 3/1961 | Voigtlander | |
| 3,879,006 A | * | 4/1975 | Staudte, Jr. | A47F 5/0823 248/223.31 |
| 3,941,343 A | * | 3/1976 | Kennedy | A47F 5/0823 248/220.31 |
| 4,093,168 A | * | 6/1978 | Buril | A47F 5/0807 248/300 |
| 4,333,625 A | * | 6/1982 | Haug | A47G 1/20 248/216.1 |
| 5,149,037 A | | 9/1992 | Smith | |
| 5,388,709 A | * | 2/1995 | Adams | A47B 81/005 211/106 |
| 5,639,049 A | | 6/1997 | Jennings | |
| 5,878,988 A | | 3/1999 | Rakower | |
| 7,198,088 B2 | | 4/2007 | McMenamin | |
| 8,056,873 B1 | | 11/2011 | Hanley | |
| 9,068,347 B2 | | 6/2015 | Moeller | |
| 9,609,974 B2 | | 4/2017 | Mateer | |
| 10,278,529 B2 | | 5/2019 | Baines | |
| 10,448,773 B2 | | 10/2019 | Muniz | |
| 10,542,835 B1 | | 1/2020 | Suozzo | |
| 10,648,492 B2 | | 5/2020 | Hanley | |
| 2010/0032536 A1 | | 2/2010 | Eagan | |

(Continued)

FOREIGN PATENT DOCUMENTS

| | | |
|---|---|---|
| CN | 212465681 U | 2/2021 |
| GB | 190515559 A | 5/1906 |
| KR | 10-2017263 B1 | 9/2019 |

*Primary Examiner* — Steven M Marsh
(74) *Attorney, Agent, or Firm* — Lambert Shortell & Connaughton; David J. Connaughton, Jr.; Justin P. Tinger

(57) ABSTRACT

A wall hanging bracket is provided. The bracket utilizes a single anchor point to connect the bracket to the wall and has a slot spaced apart from and below the anchor point. A hanger such as a curtain rod hanger, picture hanger, or the like may be slideably held in the bracket to connect the hanger to the wall. A wall hanging such as a curtain rod, picture, shelf, and the like may be connected to the hanger which is held in the bracket, and in turn connected to the wall. This system allows wall hangings to be made with a single connection point, in a much more secure and stable manner compared to the prior art.

18 Claims, 7 Drawing Sheets

(56) References Cited

U.S. PATENT DOCUMENTS

| | | | | |
|---|---|---|---|---|
| 2016/0157655 | A1* | 6/2016 | Muñiz | A47H 1/122<br>248/265 |
| 2018/0078073 | A1 | 3/2018 | Morris | |
| 2020/0305629 | A1 | 10/2020 | Hanley | |
| 2021/0345808 | A1 | 11/2021 | Berman | |
| 2024/0032717 | A1* | 2/2024 | Berman | A47H 1/142 |
| 2024/0108159 | A1* | 4/2024 | Moss | A47H 1/142 |

* cited by examiner

WALL HANGER

BACKGROUND OF THE INVENTION

The present disclosure relates generally to hanging devices for vertical surfaces. More particularly, the present disclosure relates to a wall hanging assembly using a single connection point to the wall and receives a portion of a bracket or another mechanism in a slot defined by the wall hanger. Many installations of drapery are intended for at least daily opening and closing for light control. This invention yields a mounting mechanism with improved durability for this action. Furthermore, this invention maintains the aesthetic requirements desired by consumers.

Curtain rod brackets or "hangers" typically require drilling two holes for the use of anchored screws in the wall for each hanger. Depending on the overall length of the curtain rod, additional hangers are often needed to support the weight of the combined rod and drapery. Installation requires a drill, drill bits, hammer, level, tape measure and screwdriver to install the backets. Upon removal, backing the screw anchors out of the wall results in large holes that require patching and filling.

Several products have tried to simplify the process required to hang curtain rods. Simpler products use a self-adhesive back plate with a claw-like rod cradle. This version does not allow for the desired distance from the wall that would allow the curtain to hang freely from the wall or window. Certain brand brackets use existing wood trim surrounding the window for the anchoring of prongs and a vertical bracket to provide leverage against the wall. Other do-it-yourselfers have tried using adhesive hanger strips for quick and temporary installation. While these solutions do install curtain rods, it is done in a manner that leads to wall damage, unappealing appearance, or the unreliable utility of the drapery. These other mounting devices show around the drapery in an unsightly way and prove unreliable against added loading as experienced through repeated opening and closing of drapes.

Prior art brackets require anchoring onto a window trim surround. Not all construction uses window trim, and damage to the wood caused by these hangers is troublesome to repair. Self-adhesive or 3M® brand options are not strong and can tear the sheetrock outer paper layer with force of just over ten pounds. Further, the adhesive options place the curtains so close to the wall that the drapery cannot glide across the curtain rod smoothly. These existing quick options have weaker anchoring to the wall and risk being pulled away versus conventional anchoring with screws and wall anchors.

Therefore, what is needed is a device that may efficiently and easily join a hanger bracket to a wall without the use of extensive connectors, resulting wall or trim damage, numerous tools and is still aesthetically pleasing.

SUMMARY OF THE INVENTION

The subject matter of this application may involve, in some cases, interrelated products, alternative solutions to a particular problem, and/or a plurality of different uses of a single system or article.

In one aspect, a bracket for connecting objects to a wall is provided. The bracket is formed of a body which defines a top portion having an aperture for receiving an anchor to connect the bracket to the wall. The body further defines a slot at a lower portion or "slot portion" of the body. The slot is spaced apart from the aperture, and when connected to the wall, the slot is positioned below the aperture. The slot is sized to receive a portion of a hanger, such as a traditional curtain hanger bracket, which can be slideably connected to the bracket by fitting into the slot.

In another aspect, a wall hanging assembly is provided. A bracket is connected to a wall by connecting an anchor through an aperture defined by a top portion of a body of the bracket to the wall. The body defines a slot at a portion of the body below the aperture. The slot is sized in an elongate shape to receive a portion of a hanger. The hanger is slideably received within the slot and thus is held to the wall by the bracket. An object such as a curtain rod, picture, frame, shelf, or the like may be connected or held by the hanger, and thus held to the wall.

DETAILED DESCRIPTION OF THE INVENTION

Figure 1:
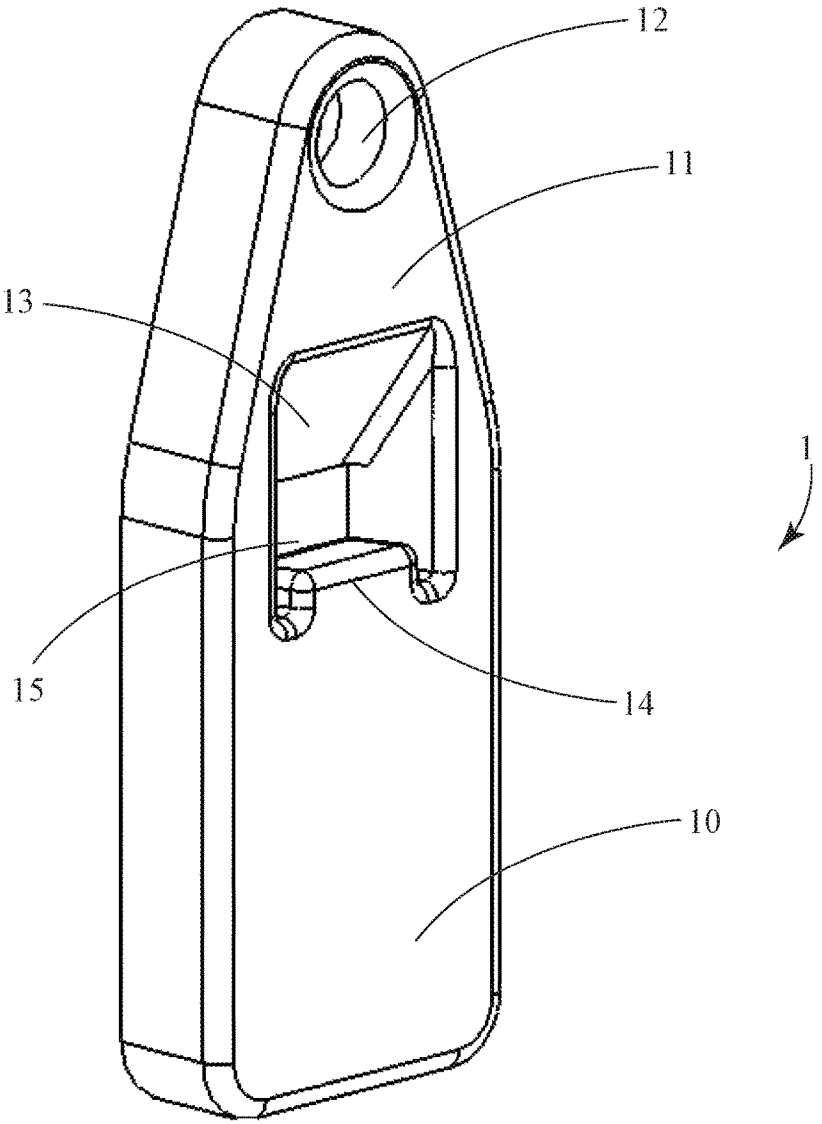
FIG. 1 provides a perspective view of an embodiment of the present disclosure.

The detailed description set forth below in connection with the appended drawings is intended as a description of presently preferred embodiments of the invention and does not represent the only forms in which the present disclosure may be constructed and/or utilized. The description sets forth the functions and the sequence of steps for constructing and operating the invention in connection with the illustrated embodiments.

Generally, the present disclosure concerns a wall hanging bracket. The bracket has a body which defines a single top anchor point and a slot below the anchor point. A hanger slideably fits into the slot and is joined to the wall by the bracket. The hanger may be any hanger such as, but not limited to, a curtain hanger, or a customized hanger having an elongate vertical leg and a working end. The bracket uses a single anchor point which is above the slot when hung. This causes the bracket to self level to a vertical orientation, and limits wall damage by only putting a single hole into the wall, rather than the multiple holes and anchors required by the prior art. The bracket is structured to limit or eliminate a pulling force on the anchor, and the anchor primarily or only experiences a downward vertical force. As such, the bracket allows a simple nail or screw connection to hold a substantial amount of weight, and substantially more than the prior art connection systems allow.

To further improve operation, force balance, and secure connection of the hanger to the bracket, various embodiments of the bracket may include the following structural modifications. In one embodiment, instead of a straight up and down bracket, the slot wall may be forwardly angled relative to the front or rear wall such that the slot has a thicker front wall than at the bottom, as shown in the figures.

This embodiment allows a hanger to sit flush against the angled wall and causes a bottom of the hanger to apply a slight and additional force to the bottom wall of the bracket which in turn urges the bottom of the bracket against the wall and balances against the force applied to the bracket by the top portion of the hanger on the top of the slot. In another embodiment, the slot may define a notch at a bottom of the slot to make a groove. The hanger may fit closely into this groove to ensure that the movement of the end portion of the hanger is limited for secure placement of the hanger. In yet another embodiment, the rear wall of the body may define a sharp protrusion such as a serration or serrations, teeth, conical or pyramid shape protrusion(s) and the like. These sharp protrusions increase the force per unit area applied by the rear of the bracket on the wall which secures the bracket in place to the wall and can carry some of the downward force applied to the bracket by the hanger and objects attached to the hanger. In still other embodiments, the bracket may define an angled ramp at a top of the slot and/or an open back of the slot. These features may allow for more easy insertion of the hanger which has an elongate leg. These embodiments may be combined in various combinations to form additional embodiments without straying from the scope of this invention.

Importantly, the anchor point connecting bracket to wall is positioned above the slot on the bracket. The bracket places the anchor point above the hanger which applies primarily a downward force on the anchor, and limits any outward horizontal force on the anchor to pull it outwardly from the wall. This allows the bracket to be connected, in many cases, with a single screw into drywall/plaster and no sheetrock anchor, and to hold substantially more weight compared to other prior art connection systems. The present disclosure allows use of a conventional curtain rod hanger kit by providing an interface to the wall with one anchor fastener. This idea uses one point of connection by placing the bracket into a pocket within the mount (solution) to rest against the wall for additional leverage. Stated another way, by having the anchor above and the hanger below in a slot, the load applied by the hanger and objects held by the hanger bears down onto the surface of the bracket slot, and translates forces to a vertical direction which the single anchor is well suited to bear.

The hangers contemplated herein are typically prior art curtain hangers, or hangers having a similar structure. Curtain hangers are known in the art to be formed in an L or right angle bracket, with a downward facing leg for connection to a wall, and a horizontal extending portion with a curved slot to receive a curtain rod. These curtain hangers require at least two or more anchors to hold them in place, and require sheetrock anchors, careful measurement and alignment, and the like. In some cases, these curtain hangers are two-piece assemblies with the leg part being separated from the horizontal curved slot part. The slot of the bracket contemplated herein is sized and configured to receive the leg part of these brackets. In further embodiments, a similarly shaped hanger may be used and instead of the curved slot for a curtain rod, may have a slot or hook for hanging a picture or painting, a notch for receiving a shelf, and any other structure for hanging or otherwise connecting objects on walls. Such hangers may be connectable to prior art two piece curtain hangers, such that the working end may be connected to the prior art leg of the bracket.

The single fastener utilized by the present disclosure reduces installation time by half or more when combined with self-tapping hardware. It also causes less damage to the wall by way of limiting holes for anchors. The bracket connection arrangement provides additional strength when coupled with conventional anchors or hardware. When using a self-tapping fastener or anchor the installation time is reduced while improving weight capability. For example, typical prior art hangers are able to hold approximately 10 pounds while the present disclosure is able to hold 30 pounds and even 40 pounds with a single screw connection to the wall. The solution of the present disclosure also requires far fewer tools, making installation easier and more accessible.

The anchors described herein which connect the bracket to the wall may be any connector capable of passing through the top aperture of the bracket and joining the bracket and wall. Typical anchors include, but are not limited to screws, bolts, nails, drywall anchors and screws, and the like.

Figure 2:
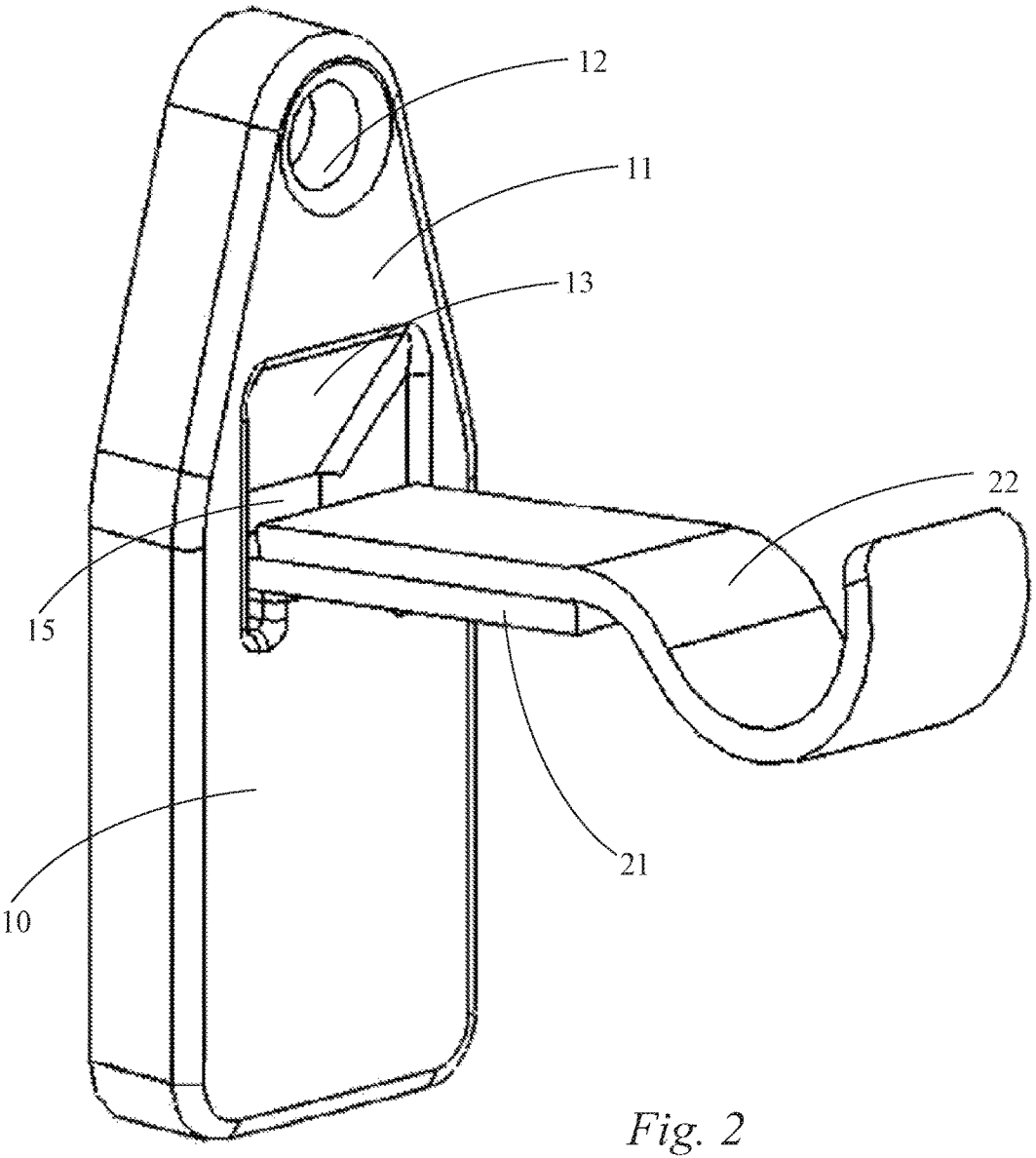
FIG. 2 provides a perspective view of an embodiment of the present disclosure having a hanger held to the bracket.

Turning now to FIGS. 1 and 2, a perspective view of one embodiment of the present disclosure is shown, and in FIG. 2 the hanger is shown held in the bracket. The bracket 1 is formed of a body 10 which has a slot portion and a top portion 11, with the top portion being above the slot portion when vertically oriented. The top portion 11 defines an anchor hole aperture 12 through which an anchor (not shown) such as a screw can pass and connect the bracket 10 to the wall (not shown). The body 10 defines slot 15 into which a traditional curtain hanger bracket may fit. The curtain hanger is shown here as a traditional two part hanger having the L shaped wall-connector leg 21 and the arm 22 with curved slot to receive the curtain rod. The slot 15 has an angled ramp 13 at its top, and a tab 14 at the bottom front opening. The angled ramp 13 allows for easy entry of the hanger connector leg 21.

Figure 3:
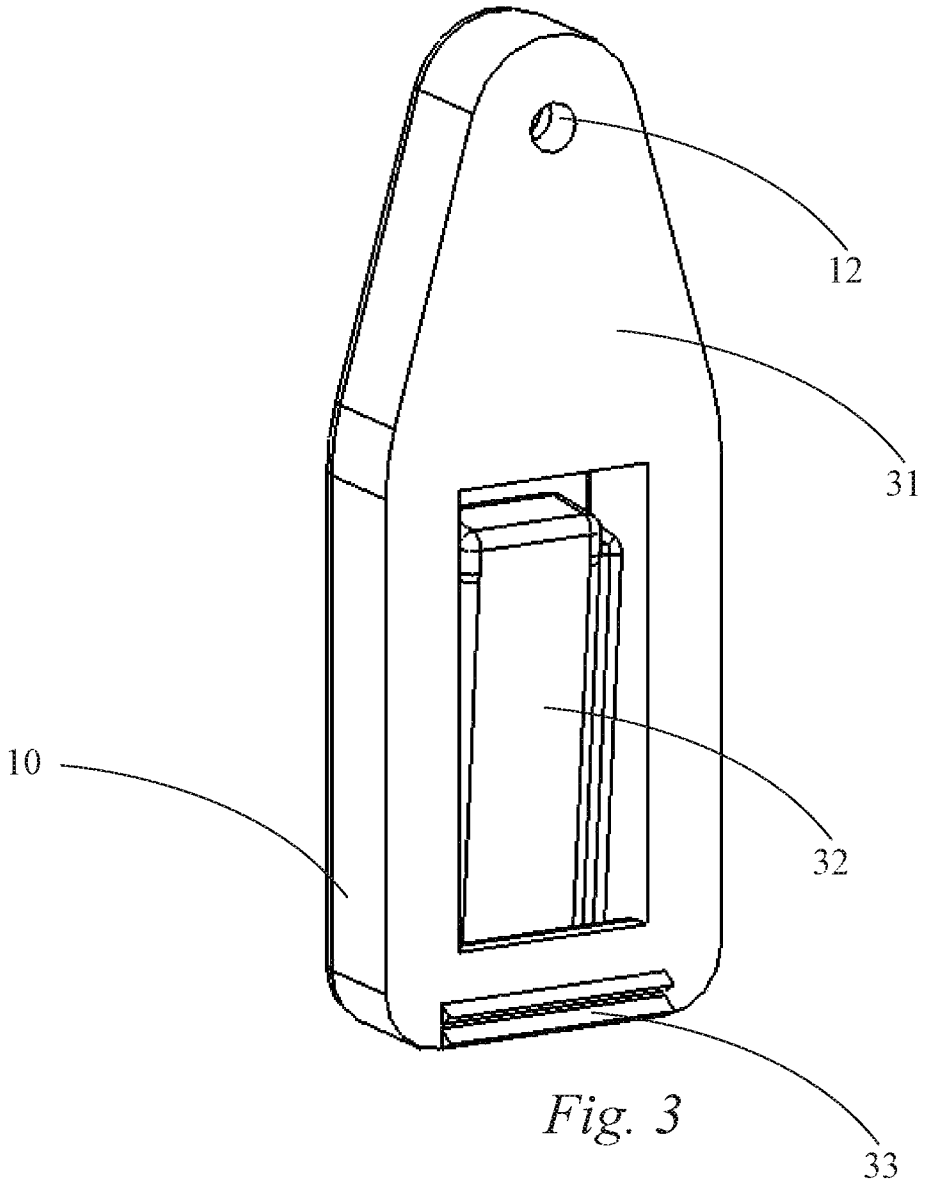
FIG. 3 provides a rear view of an embodiment of the present disclosure.

FIG. 3 shows a rear view of another embodiment of the bracket. The aperture 12 at top portion 11 extend through the body 10. On the rear face 31 are two serrations 33 at the bottom of the body. These serve to apply additional force to the wall on which the bracket is attached and in some embodiments, carry some vertical weight applied on the bracket for a more secure connection. The slot 15 has an open rear portion to make insertion of the hanger easier. The wall 32 of the slot is forwardly angled, as best seen in the cutaway views of FIGS. 4 and 5.

Figure 4:
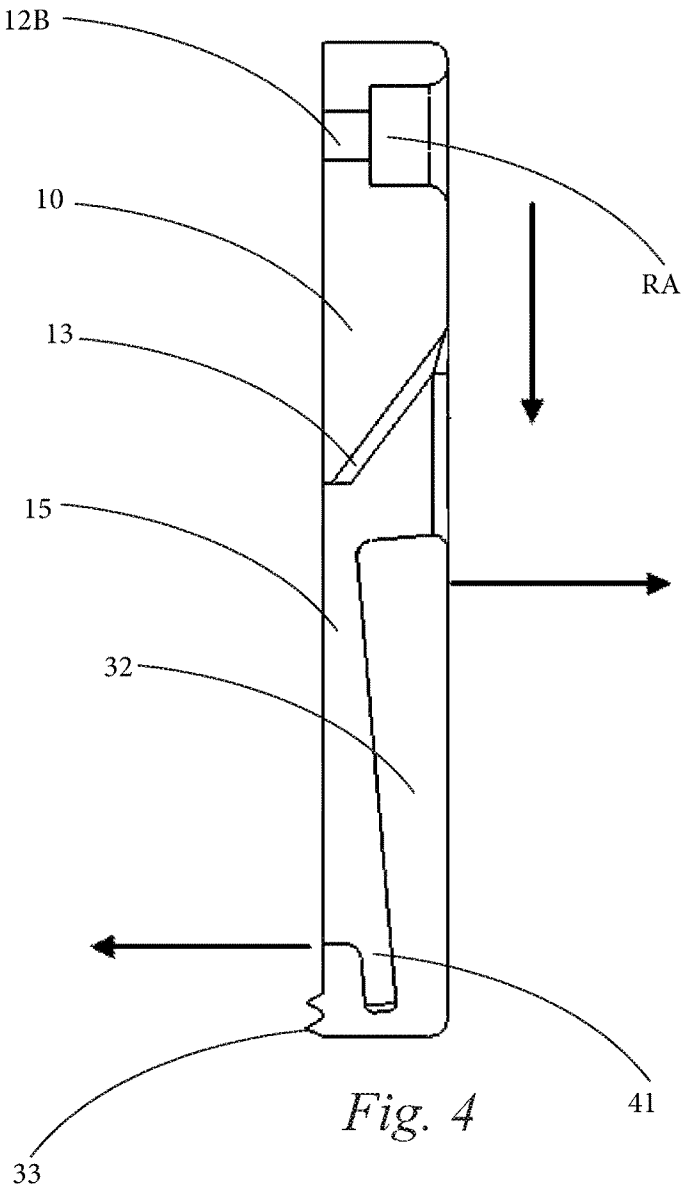
FIG. 4 provides a perspective cutaway view of an embodiment of the present disclosure.
Figure 5:
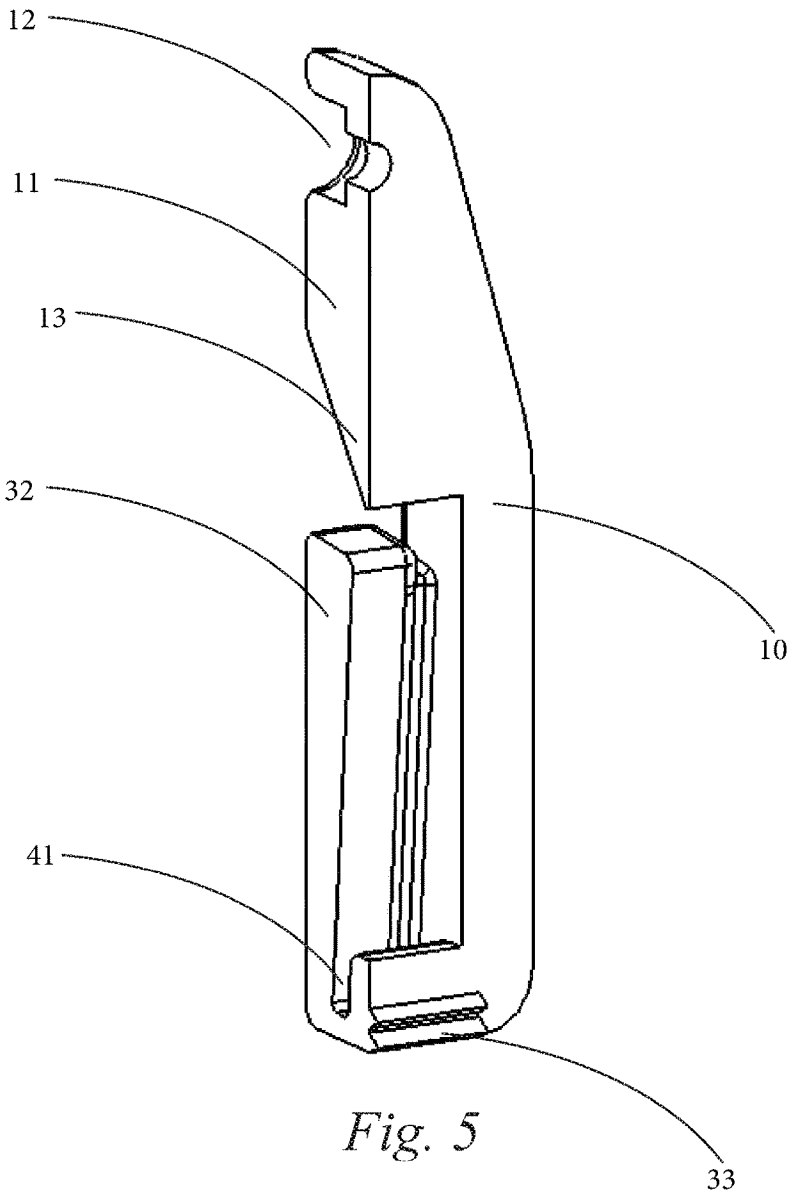
FIG. 5 provides a side cutaway view of an embodiment of the present disclosure.

FIGS. 4 and 5 provides a side cutaway view of an embodiment of the bracket. The body 10 defines the slot 15 which has a forwardly angled wall 32. Also visible in this view is the notch defining groove 41 at the bottom of the slot 15. The hanger leg 21 fits into this groove 41 and holds it in place abutting against the angled wall 32. Aperture 12 has a wide portion 12A for receiving a head of a screw and the like, and a narrow portion 12B for the extending part of the anchor such as screw. As shown by arrows, the horizontal forces applied by the hanger are balanced at bottom applied to wall by serrations 33, and at a top part of the slot 15. Thus, force at the top portion 11 of the bracket body 10 is limited primarily to the downward weight of the load applied by gravity.

Figure 6:
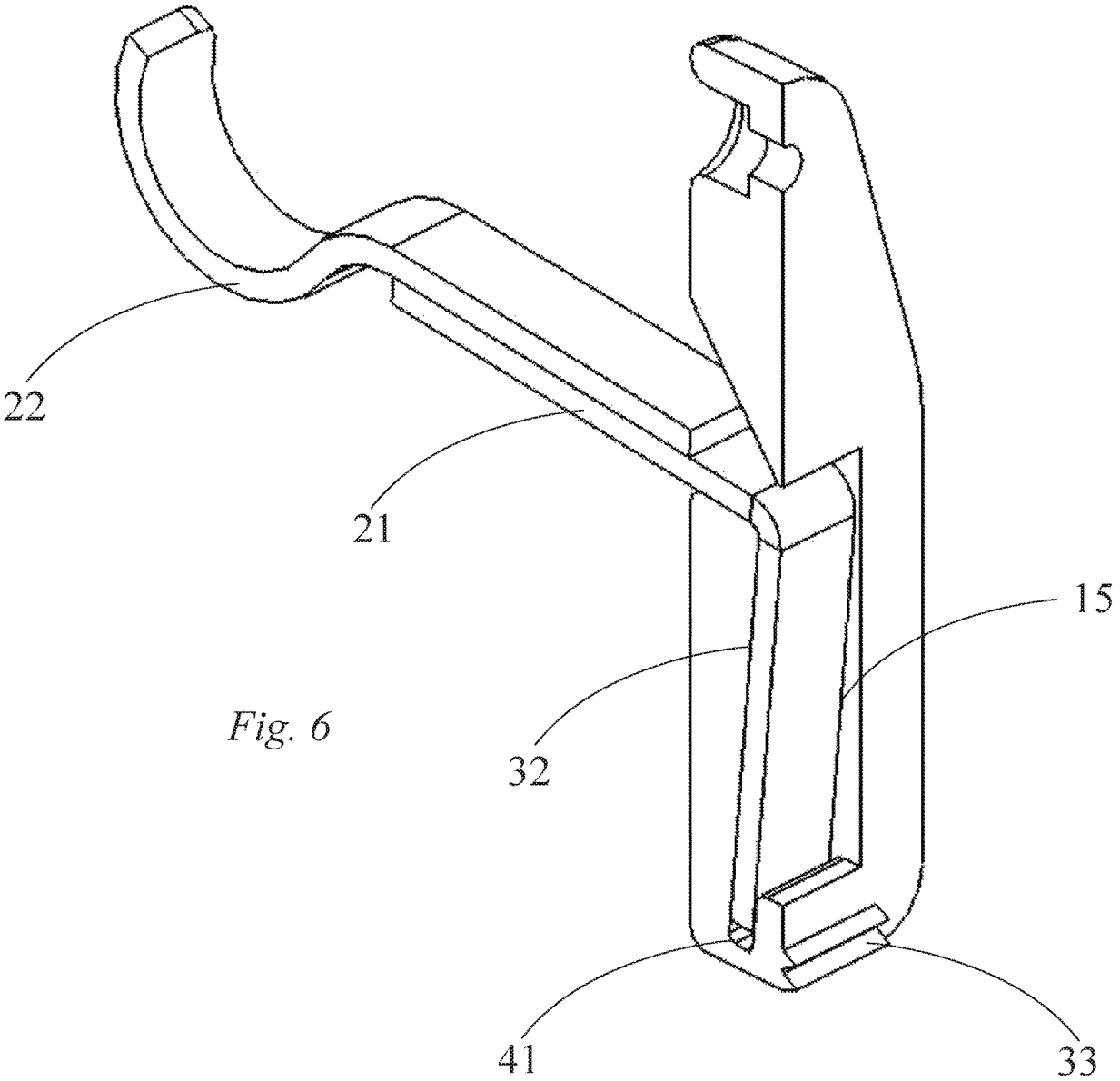
FIG. 6 provides a rear perspective cutaway view of yet another embodiment of the present disclosure.

FIG. 6 provides a rear cutaway view showing the hanger 21, 22 fitted into slot 15. Hanger leg 21 fits into groove 41 and abuts against angled wall 32. The angled front face allows the hanger leg 21 to lift out of groove 41, be pivoted slightly, and then exit the slot 15. When in place, weight applied to the curved end of hanger 22 will apply a force perpendicular to the slot, urging the serrations 33 towards the wall.

Figure 7:
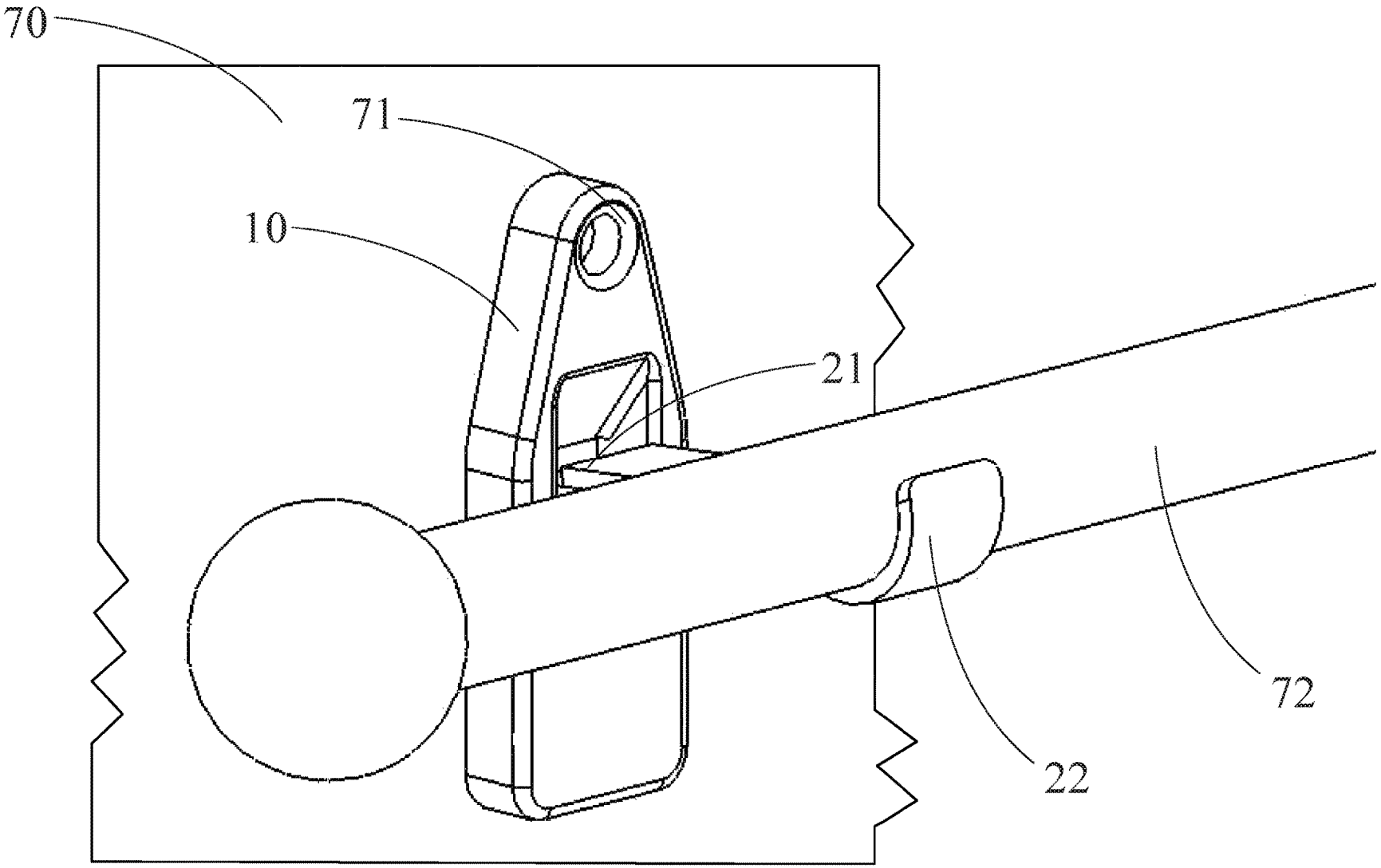
FIG. 7 provides a view of an embodiment of the present disclosure attached to a wall and holding a curtain rod.

FIG. 7 provides a view of an embodiment of the present disclosure attached to a wall and holding a curtain rod. The bracket body 10 connects to wall 70 via anchor such as a screw or nail which fits into area 71, which in this embodiment may be a screw, though other anchors may of course be used. The hanger 21, 22, fits into slot 15 and holds curtain rod 72. The single connection point of the bracket allows the bracket to be self-aligning as it can pivot about the anchor and gravity draws it to the proper vertical orientation.

While several variations of the present disclosure have been illustrated by way of example in preferred or particular embodiments, it is apparent that further embodiments could be developed within the spirit and scope of the present disclosure, or the inventive concept thereof. However, it is to be expressly understood that such modifications and adaptations are within the spirit and scope of the present disclosure, and are inclusive, but not limited to the following appended claims as set forth.

What is claimed is:

1. A bracket for connecting to a wall comprising:

a body, the body defining an aperture for receiving an anchor at a top portion;

the body further defining a slot at a portion of the body spaced apart from the aperture, the slot sized to receive a portion of a hanger which can be slideably connected to the bracket in the slot;

wherein the slot defines an angled front wall that is forwardly angled relative to a rear wall of the body.

2. The bracket of claim 1 wherein the slot further comprises a notch at a bottom of the slot, the notch defining a narrow groove to receive a portion of the hanger.

3. The bracket of claim 2 wherein the slot further comprises a notch at a bottom of the slot, the notch defining a narrow groove to receive a portion of the hanger.

4. The bracket of claim 1 wherein a rear of the body defines a sharp protrusion at a bottom portion, the sharp protrusion configured to apply a force to a wall to which the bracket is connected.

5. The bracket of claim 1 wherein a rear of the body defines a plurality of serrations at a bottom portion.

6. The bracket of claim 1 further comprising a hanger positioned in the slot.

7. The bracket of claim 6 wherein the hanger is a curtain rod hanger.

8. The bracket of claim 1 wherein the slot has an open rear wall to allow for entry of an elongate leg of the hanger.

9. The bracket of claim 1 wherein the body defines an angled ramp at a top of the slot.

10. The bracket of claim 1 wherein the aperture is the only aperture for receiving the anchor.

11. A wall hanger assembly comprising:

a bracket for connecting to a wall comprising:

a body, the body defining an aperture, an anchor engaged with the wall through the aperture and securing the bracket to the wall;

the body further defining a slot at a portion of the body below the aperture, the slot sized to receive a portion of a hanger; and the hanger slideably received within the slot and the hanger held to the wall by the bracket;

wherein the slot defines an angled front wall that is forwardly angled relative to a rear wall of the body the portion of the hanger abutting the angled front wall.

12. The assembly of claim 11 wherein the hanger is a curtain hanger.

13. The assembly of claim 12 further comprising a curtain rod attached to the curtain hanger.

14. The assembly of claim 11 wherein the slot further comprises a notch at a bottom of the slot, the notch defining a narrow groove, an end portion of the hanger positioned within the narrow groove.

15. The assembly of claim 11 wherein the slot further comprises a notch at a bottom of the slot, the notch defining a narrow groove, an end portion of the hanger positioned within the narrow groove.

16. The assembly of claim 11 wherein a rear of the body abutting the wall defines a sharp protrusion at a bottom portion, the sharp protrusion configured to apply a force to the wall to which the bracket is connected.

17. The assembly of claim 11 wherein a rear of the body abutting the wall defines a plurality of serrations at a bottom portion.

18. The assembly of claim 11 wherein the body defines an angled ramp at a top of the slot shaped to allow removal and insertion of the hanger into the slot.

* * * * *